United States Patent [19]

Ishizaki

[11] 4,227,376

[45] Oct. 14, 1980

[54] COOLING SYSTEM

[76] Inventor: Yoshihiro Ishizaki, Kamakura, Japan

[21] Appl. No.: 962,761

[22] Filed: Nov. 21, 1978

[51] Int. Cl.[3] ..... F25D 11/04

[52] U.S. Cl. ..... 62/434; 62/437

[58] Field of Search ..... 62/430, 431, 434, 437

[56] References Cited

U.S. PATENT DOCUMENTS

| | | | |
|---|---|---|---|
| 2,283,818 | 5/1942 | Reiser | 62/431 |
| 2,585,360 | 2/1952 | Williams | 62/430 |
| 3,018,638 | 1/1962 | Winkler | 62/430 |

FOREIGN PATENT DOCUMENTS

| | | |
|---|---|---|
| 34-6020 | 4/1959 | Japan . |
| 35-8716 | 4/1960 | Japan . |
| 36-10156 | 7/1961 | Japan . |
| 5321781 | 5/1974 | Japan . |

*Primary Examiner*—Ronald C. Capossela
*Attorney, Agent, or Firm*—Finnegan, Henderson, Farabow, Garrett & Dunner

[57] ABSTRACT

A cooling system for a vehicle in which a refrigerant is compressed and subsequently expanded to lower the temperature of a portion of the interior of the vehicle as well as the temperature of a refrigerated storage compartment in the vehicle. The cooling of the two different portions of the vehicle may be independently and automatically controlled. The refrigerated storage compartment is characterized by an insulated container being detachably affixed to the vehicle with a portion of the container in contact with, a portion of the cooling system that is cooled by the passage of refrigerant therethrough.

5 Claims, 5 Drawing Figures

COOLING SYSTEM

SUMMARY OF THE INVENTION

Cooling system includes compressor means, an air conditioning circuit and a refrigerating circuit having evaporation means and refrigerating box means which is removably mounted on base means and positioned in heat exchanging relationship with the evaporation means when the box means is on the base means.

The present invention relates to a cooling system including an air conditioning circuit as well as a refrigerating circuit. More specifically, the present invention pertains to a cooling system for transportation vehicles such as automobiles and boats.

An object of the present invention is to provide a cooling system which includes removable refrigerating box means adapted to be cooled by the refrigerating circuit in the system and can be carried anywhere as desired simply by removing it from the circuit.

Another object of the present invention is to provide a cooling system for a transportation vehicle which includes portable refrigerating box means having refrigeratory accummulating means.

A further object of the present invention is to provide a cooling system for a transportation vehicle having compact coolant compressing means.

According to the present invention, the above and other objects can be accomplished by a cooling system for a transportation vehicle which comprises compressor means for providing a supply of compressed coolant, an air conditioning circuit connected with said compressor means for receiving the compressed coolant therefrom and returning the coolant thereto, said air conditioning circuit including condensing means and evaporation means, a refrigerating circuit connected to receive the compressed coolant from the compressor means and return the coolant thereto, said refrigerating circuit including evaporation means and refrigerating box means which is removably mounted on base means and positioned in heat exchange relationship with the evaporation means in the refrigerating circuit when the box means is on the base means, said box means preferably having refrigeratory accummulating means so that the box means can be be maintained under a cooled condition even when it is removed from the base means. Preferably, the refrigerating circuit may use the condensing means of the air conditioning circuit in common. For the purpose, the refrigerating circuit may be connected with the air conditioning circuit between the condenser and evaporation means. A cooling circuit may be provided for heat exchange with the condensing means in the air conditioning circuit. Such cooling circuit may use liquefied coolant so that it can be constructed compact in size.

The compressor means may be of a plurality of stages and the coolant from the air conditioning or refrigerating circuit may be returned to the compressor means at any stage thereof. Suitable valve arrangements may be provided so that the cooling effect can appropriately be controlled by controlling the return path of the coolant through actuation of the valves.

The evaporation means in the refrigerating circuit may include cooling plate means which is adapted to be brought into heat exchange contact with corresponding surface means in the refrigerating box means. In preferable arrangement, such surface means of the refrigerating box means is formed at the bottom of the cryogenic accummulating means. The accummulating means may comprise housing means containing a material or a mixture of materials having a large specific heat in the temperature range between −30° C., and 0° C. For example, water, a solution of ethylene glycol with water or other liquid or metal powders may be used.

The above and other objects and features of the present invention will become apparent from the following descriptions of a preferred embodiment taking reference to the accompanying drawings, in which.

Figure 1:
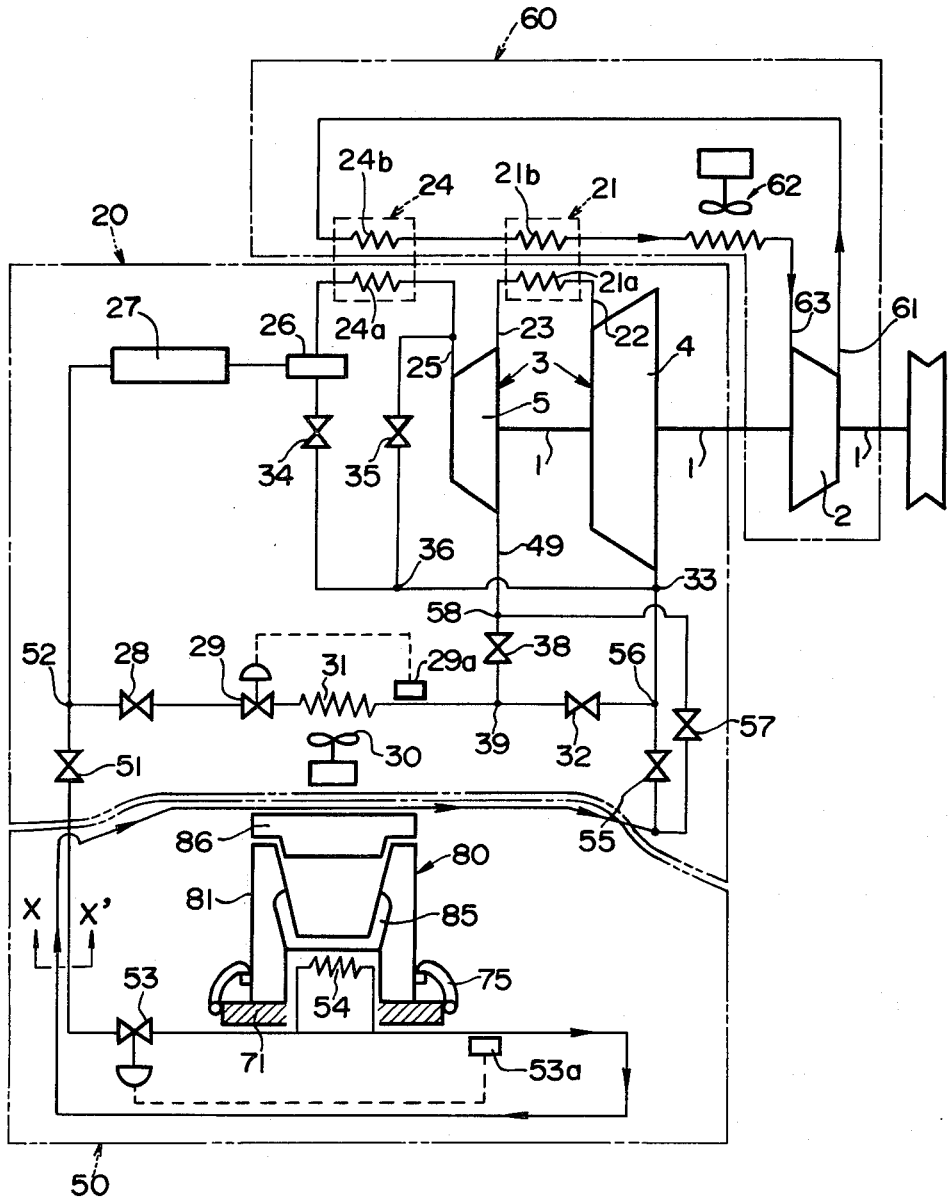
FIG. 1 is a circuit diagram showing a cooling system in accordance with one embodiment of the present invention.

Referring now to the drawings, particularly to FIG. 1, the cooling system shown therein includes an air conditioning circuit 20, a refrigerating circuit 50 and a cooling circuit 60. A driving shaft 1 is provided for transmitting a power from a suitable prime mover such as an engine through a suitable clutch mechanism. On the drive shaft 1, there are mounted a coolant pumping rotor 2 and a first stage rotor 4 and a second stage rotor 5 of a two stage compressor 3. The first and second rotors 4 and 5 of the compressor 3 are mounted on the drive shaft 1 with 180° phase difference.

Referring now to the air conditioning circuit 20, the outlet 22 of the first stage rotor 4 of the compressor 3 is connected with a first condensing coil **21*a* of a first condensor 21. The coil 21*a* is in turn connected with the inlet 23 of the second stage rotor 5. The second stage rotor 5 has an outlet 25 which is connected with a second condensing coil 24*a* of a second condensor 24. The coil 24*a* is connected through an oil separator 26 with a liquid reservoir 27 which is in turn connected through a shut-off valve 28 and an expansion valve 29 with an evaporator 31. The expansion valve 29 is associated with a temperature sensing element 29*a* so that it is controlled in accordance with the temperature in the vicinity of the evaporator 31**.

The evaporator 31 may be located in a space to be cooled, such as an inside room of an automobile or a boat and may be provided with an air cleaning agent such as silica gel, activated carbon and a glass fiber sheet. A blower 30 is provided for circulating air through the evaporator 31.

The evaporator 31 is connected on one hand through a valve 32 with the inlet 33 of the first stage rotor 4 of the compressor 3 and on the other hand through a valve 38 with the inlet 49 of the second stage rotor 5. The valve 32 functions to pass only such part of coolant of which temperature has been increased through a heat exchange with the air in the aforementioned space at the evaporator 31. On the contrary, the valve 38 functions to pass low temperature coolant.

The oil separator 26 is connected through a valve 34 with the inlet 33 of the first stage rotor 4 of the compressor 3 so that oil separated at the separator 26 is returned to the rotor 4. The outlet 25 of the second stage rotor 5 is connected through a valve 35 with a line connecting the valve 34 and the inlet 33 of the first stage rotor 4 at a point designated by 36.

The refrigerating circuit 50 includes an evaporator 54 which is connected through a shut-off valve 51 and an expansion valve 53 with a line connecting the liquid reservoir 27 and the shut-off valve 28 at a point designated by 52. The expansion valve 53 is provided with a temperature sensing element 53*a* so that it is controlled in accordance with the temperature around the evaporator 54. The evaporator 54 is connected on one hand through a valve 55 with a line connecting the inlet 33 of the first stage rotor 4 of the compressor 3 to the valve 32 at a point designated by 56 and on the other hand through a valve 57 a line connecting the inlet 49 of the second stage rotor 5 to the valve 38 at a point designated by 58. The valve 55 corresponds to the valve 32 in the air conditioning circuit 20 and functions to pass the coolant of which temperature has been increased at the evaporator 54. The valve 57 corresponds to the valve 38 and functions to pass the low temperature coolant only.

The cooling circuit 60 includes a first and second coils 21*b* and 24*b* which are respectively positioned in heat exchanging relationship with the evaporator coils 21*a* and 24*a*. The coil 24*b* is connected at one end with the outlet 61 of the pumping rotor 2 and at the other end with the coil 21*b* which is in turn connected through a heat radiator 62 with the inlet 63 of the pumping rotor 2.

Figure 2:
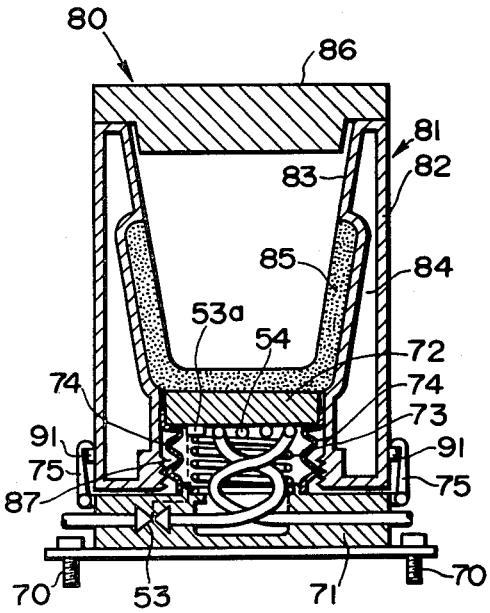
FIG. 2 is a sectional view of the refrigerating box and the evaporating section of the refrigerating circuit in the embodiment shown in FIG. 1.
Figure 3:
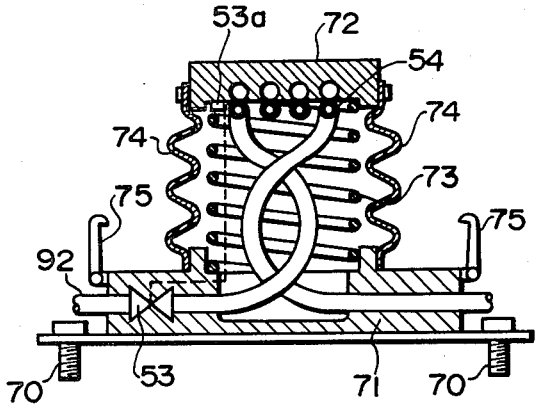
FIG. 3 is an enlarged sectional view of the evaporating section of the refrigerating circuit.
Figure 5:
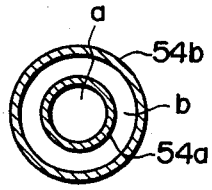

Referring specifically to FIGS. 2 and 3, the evaporator 54 is passed through a base plate 71 and extends above the base plate. A cooling plate 72 is mounted on the evaporator 54 and secured thereto so that it is cooled by the evaporator 54. The temperature sensing element 53*a* is also disposed in contact with the cooling plate 72 so that it senses the temperature of the cooling plate 72. A coil spring 73 is disposed between the base plate 71 and the cooling plate 72 so that the plate 72 is normally biased in the upward direction. A bellows type shield 74 to encircle the evaporator 54. The shield 74 may be made of a plastic material or a rubber material and functions to decrease thermal loss in the evaporator 54. As shown in FIG. 5, the tube in the evaporator 54 is of a double-walled construction having an inner tube 54*a* connected with the valve 51 and an outer tube 54*b* connected with the valves 55 and 57.

On the base plate 71, there is mounted a refrigerating box assembly 80 which is comprised of a hollow shell 81 and a refrigeratory accummulator 85 constituted in the form of an open-top container. The shell 81 is of a double-walled structure having an outer wall 82 and an inner wall 83 with a theremally insulative 84 therebetween. The shell 81 is opened at the upper and lower ends and the container-shaped accummulator 85 is fitted to the inner wall 83 of the shell 81. Thus, the accummulator 85 has an exposed bottom.

Figure 4:
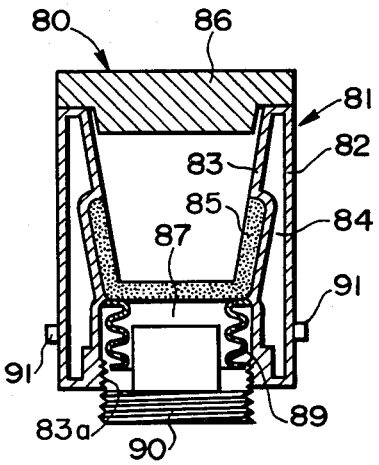
FIG. 4 is a sectional view showing the refrigerating box removed from the base plate; and, FIG. 5 is a sectional view of the coolant tube used in the evaporating section of the refrigerating circuit and taken along the line X–X′ in FIG. 1.

The accummulator 85 is comprised of a hollow housing which contains a material or a mixture of materials having a relatively large specific heat under a temperature range between −30° C. and 0° C. For example, water or a water solution of ethylene glycol may be used for the purpose. Alternatively a suitable liquid or metal powder may be used. The shell 81 may be made of a suitable material such as aluminum. On the top of the shell 81, there is provided a lid or closure 86 which is made of a suitable heat insulating material. Referring to FIG. 4, it will be noted that a space 87 is defined by the shell 81 beneath the refrigeratory accummulator 85.

As shown in FIG. 2, the shell 81 is placed on the base plate 71 and clamped in position by clamping fasteners 75 which are provided on the base plate 71 and adapted to be engaged with cooperating fittings 91 on the shell 81. In this position, the evaporator 54 and the cooling plate 72 as well as the shield 74 are disposed in the space 87 and the cooling plate 72 is forced under the action of the spring 73 into contact with the bottom of the refrigeratory accummulator 85.

The bottom end of the inner wall 83 of the shell 81 has an internal thread 83*a* so that a heat insulative plug 90 may be attached to the bottom of the shell 81 when the shell 81 is removed from the base plate 71 in order to prevent the bottom of the refrigeratory accummulator 85 from being exposed to atmosphere. A removable bellows 89 may be inserted into the space 87 as necessary.

In operation, the drive shaft 1 is rotated by a prime mover (not shown) through an appropriate clutch mechanism (also not shown) so that the pumping rotor 2 and the first and second stage rotors 4 and 5 of the compressor 3 are driven. The coolant in the air conditioning circuit 20 such as freon is therefore compressed at first by the first stage rotor 4 and discharged through the outlet 22 into the condensing coil 21*a* where the coolant is cooled through a heat exchange with the coolant passing through the coil 21*b*. The coolant in the condensing coil 21*a* is then directed through the inlet 23 into the second stage compressor 5 to be compressed thereby and discharged through the outlet 25 into the condensing coil 24*a*. In the condensing coil 24*a*, the coolant is further cooled through a heat exchange with the coolant passing through the coil 24*b*.

The coolant is then directed from the condensing coil 24*a* to the oil separator 26 to separate the oil component which is returned through the valve 34 to the inlet 33 of the first stage rotor 4. The coolant is passed from the oil separator 26 through the liquid reservoir 27, the shut-off valve 28 and the expansion valve 29 into the evaporator 31. The expansion valve 29 is controlled by the temperature sensitive element 29*a* in such a manner that its opening increases when the room temperature is high. In the evaporator 31, the coolant is heated through a heat exchange with the air which is sent by the blower 30. When the room temperature is sufficiently decreased, the expansion valve 29 is closed under the control of the temperature sensitive element 29*a*.

The coolant is then passed from the evaporator 31 through the valve 32 to the inlet 33 of the first stage rotor 4 when the temperature of the coolant is relatively high. If the temperature of the coolant has not been increased, even after the heat exchange at the evaporator 31, it is returned through the valve 38 to the inlet 49 of the second rotor 5 for recirculation.

When it is desired to cool the refrigerating box 80, the shut-off valve 51 is opened to direct the coolant from the reservoir 27 through the expansion valve 53 to the evaporator 54. The coolant is at first passed through the inner tube 54*a* and then through the outer tube 54*b* and functions to cool the plate 72. Since the cooling plate 72 is in contact with the bottom of the refrigeratory accummulator 85, the latter is also cooled. In an arrangement wherein the accummulator 85 is not provided, the shell of the refrigerating box may directly be cooled. In such an instance a suitable water container may be disposed in the shell so that the water in the container is refrigerated.

When the refrigerating box 80 is adequately cooled, the expansion valve 53 is closed under the function of the temperature sensing element 53*a*. The coolant from the evaporator 54 is returned to the compressor 3 either through the valve 55 or through the valve 57 in accordance with the temperature thereof. When desired, the refrigerating box 80 may be removed from the base plate 71 simply by disengaging the clamps 75 from the fittings 91. After that, the heat insulative plug 90 may be put on the bottom of the box 80 which can then be carried as desired maintaining an adequate cooling capability.

The aforementioned inner tube 54*a* may be made of a suitable metal so that an appropriate heat exchange relationship is established between the space a in the inner tube 54*a* and the space b between the tubes 54*a* and 54*b* as depicted in FIG. 5. When the inner tube 54*a* is made of a plastic or rubber material, a wire or wires of a suitable metal so that an adequate thermal conductivity can be provided in the inner tube 54*a*. The double-walled construction of the tube is considered as advantageous in that the coolant in the inner tube 54*a* is preliminary cooled by the coolant in the outer tube 54*b*. Where the system is applied to an automobile, the liquid reservoir 27 and the shut-off valve 51 may be located in the engine compartment, and the temperature of these components may become as high as 30° C. to 45° C. in summer time. However, by passing the coolant through the inner tube 54*a*, it is practically possible to decrease the temperature by about 10° C.

When it is desired to provide a strong refrigeration at the refrigerating box 80 with a relatively small amount of cooling in the room, the valve 32 may be closed so that the coolant from the evaporator 31 of the air conditioning circuit 20 is returned only to the inlet 49 of the second stage rotor 5. Then, the expansion rate across the evaporator 31 is decreased to provide a decreased amount of cooling.

The coolant through the condensing coils 21*a* and 24*a* are cooled by the coolant in the cooling circuit 60 as mentioned previously. The coolant in the circuit 60 may be water, oil, or a water solution of ethylene glycol or methanol and fed from the outlet 61 of the pumping rotor 2. The coolant is passed through the coil 24*b* and then through the coil 21*b* to remove heat from the coolant in the condensing coils 24*a* and 21*a* and finally to the heat radiator 62. The heat radiator 62 may be positioned at the front end of the automobile so that the coolant in the circuit 60 is cooled by air. In the radiator 62, the coolant in liquid phase is cooled by air so that it is possible to attain a highly efficient heat exchange. Further, a high efficienty is also attained in the second condensor 24 since the coolant in the condensor coil 24*a* is in a vapor-liquid phase. Thus, the system can be made compact as a whole.

The arrangements of the valves, such as the valves 28, 32, 38 and 51 may be changed or modified as desired. Thus, the invention is in no way limited to the details of the illustrated arrangements but changes or modifications may be made without departing from the scope of the appended claims.

I claim:

1. A system for cooling portions of a transportation vehicle, said system comprising:

(a) compressor means for providing compressed refrigerant;

(b) an air conditioning circuit connected to said compressor means for receiving compressed refrigerant therefrom and returning refrigerant thereto, said air conditioning circuit including condensing means and first evaporating means;

(c) a refrigeration circuit connected to said compressor means for receiving compressed refrigerant from said compressor means and returning refrigerant thereto, said refrigeration circuit including second evaporating means and a cooling plate disposed to receive refrigerant from said second evaporating means; and (d) a storage container detachably affixed to said vehicle, said container including a heat conducting surface maintained in a heat exchange relationship with said cooling plate when said storage container is affixed to said vehicle, said container further including means for accumulating the low temperature conducted to said heat conducting surface from said cooling plate.

2. The system of claim 1 wherein said refrigeration circuit receives refrigerant from the condensing means of said air conditioning circuit.

3. The system of claim 1 wherein said system includes a cooling circuit in a heat exchange relationship with the condensing means of the air conditioning circuit.

4. The system of claim 2 wherein said compressor means comprises a compressor having multiple stages, said system further including valve means for directing refrigerant from said air conditioning circuit and said refrigeration circuit to selected stages of said compressor.

5. The system of claim 2 including thermal insulation means disposed to insulate said heat conducting surface when said storage container is detached from said vehicle.

* * * * *